US012426753B2

(12) United States Patent
Swett et al.

(10) Patent No.: US 12,426,753 B2
(45) Date of Patent: Sep. 30, 2025

(54) WASHABLE BIN FOR A ROBOT VACUUM CLEANER

(71) Applicant: iRobot Corporation, Bedford, MA (US)

(72) Inventors: David Orrin Swett, Waltham, MA (US); Lien Hoffman, Somerville, MA (US); Yanhan Li, Belmont, MA (US)

(73) Assignee: iRobot Corporation, Bedford, MA (US)

( * ) Notice: Subject to any disclaimer, the term of this patent is extended or adjusted under 35 U.S.C. 154(b) by 565 days.

(21) Appl. No.: 15/815,099

(22) Filed: Nov. 16, 2017

(65) Prior Publication Data

US 2019/0142233 A1 May 16, 2019

(51) Int. Cl.
*A47L 9/14* (2006.01)
*A47L 9/10* (2006.01)
(Continued)

(52) U.S. Cl.
CPC ..... *A47L 9/1409* (2013.01); *A47L 9/106* (2013.01); *A47L 9/122* (2013.01); *A47L 9/1463* (2013.01);
(Continued)

(58) Field of Classification Search
CPC . A47L 9/1409; A47L 9/10; A47L 9/12; A47L 9/122; A47L 11/4013;
(Continued)

(56) References Cited

U.S. PATENT DOCUMENTS 4,545,794 A * 10/1985 Himukai ..... A47L 9/00 15/327.7
6,883,201 B2 4/2005 Jones et al.
(Continued)

FOREIGN PATENT DOCUMENTS

CN 203943625 11/2014
CN 209377482 U 9/2019
(Continued)

OTHER PUBLICATIONS

"Chinese Application Serial No. 201821885711.1, Response filed Sep. 29, 2019 to Office Action mailed Sep. 16, 2019", w/ current English claims, claims not amended in response, 9 pgs.
(Continued)

*Primary Examiner* — Brian D Keller
*Assistant Examiner* — Marcel T Dion
(74) *Attorney, Agent, or Firm* — Schwegman Lundberg & Woessner, P.A.

(57) ABSTRACT

A cleaning bin mountable to an autonomous cleaning robot operable to receive debris from a floor surface includes an inlet positioned between lateral sides of the cleaning bin and an outlet configured to connect to a vacuum assembly, the vacuum assembly operable to direct an airflow from the inlet of the cleaning bin to the outlet of the cleaning bin. The cleaning bin also includes a debris chamber to receive debris from the airflow, an airflow chamber separated from the debris chamber by a prefilter, the prefilter forming at least a portion of a top surface of the debris chamber and at least a portion of a bottom surface of the airflow chamber, and a filter socket configured to receive a filter and provide the airflow to through the filter to the outlet of the cleaning bin, wherein the filter is positioned substantially perpendicular to the prefilter when the filter is positioned in the filter socket.

20 Claims, 13 Drawing Sheets

(51) Int. Cl.
*A47L 9/12* (2006.01)
*A47L 11/40* (2006.01)

(52) U.S. Cl.
CPC ..... *A47L 11/4013* (2013.01); *A47L 2201/00* (2013.01)

(58) Field of Classification Search
CPC .. A47L 11/4025; A47L 2201/00; A47L 9/106; A47L 9/1463
See application file for complete search history.

(56) References Cited

U.S. PATENT DOCUMENTS

| | | | | |
|---|---|---|---|---|
| 8,505,158 | B2 * | 8/2013 | Han | A47L 7/02 15/347 |
| 8,741,013 | B2 | 6/2014 | Swett et al. | |
| 8,881,339 | B2 | 11/2014 | Gilbert, Jr. et al. | |
| 9,320,398 | B2 | 4/2016 | Hussey et al. | |
| 2005/0015920 | A1 * | 1/2005 | Kim | A47L 9/1409 15/352 |
| 2007/0143949 | A1 | 6/2007 | Chiu | |
| 2008/0201895 | A1 * | 8/2008 | Kim | A47L 9/106 15/319 |
| 2008/0235899 | A1 * | 10/2008 | Haan | H02K 9/04 55/342 |
| 2008/0276407 | A1 * | 11/2008 | Schnittman | A47L 11/34 15/319 |
| 2011/0232024 | A1 * | 9/2011 | Stein | A47L 9/00 15/347 |
| 2012/0054980 | A1 | 3/2012 | Kim et al. | |
| 2012/0199006 | A1 * | 8/2012 | Swett | A47L 9/106 96/417 |
| 2012/0311813 | A1 | 12/2012 | Gilbert, Jr. et al. | |
| 2013/0061420 | A1 * | 3/2013 | Vanderstegen-Drake | A47L 9/00 15/347 |
| 2013/0232718 | A1 | 9/2013 | Baek et al. | |
| 2013/0305483 | A1 * | 11/2013 | Dyson | A47L 9/1616 15/353 |
| 2013/0305484 | A1 * | 11/2013 | Dyson | A47L 9/009 15/353 |
| 2014/0182627 | A1 | 7/2014 | Williams et al. | |
| 2015/0107119 | A1 | 4/2015 | Yu Chen | |
| 2015/0107449 | A1 | 4/2015 | Son | |
| 2015/0113761 | A1 | 4/2015 | Nijhuis et al. | |
| 2016/0166126 | A1 | 6/2016 | Morin et al. | |
| 2016/0198913 | A1 * | 7/2016 | Oka | A47L 9/122 15/340.1 |
| 2016/0206161 | A1 * | 7/2016 | Oka | A47L 5/22 |
| 2016/0302637 | A1 | 10/2016 | Wennerstrom | |
| 2017/0020355 | A1 * | 1/2017 | Wennerstrom | A47L 9/122 |
| 2017/0224184 | A1 * | 8/2017 | Runnoe | A47L 11/4044 |
| 2017/0273532 | A1 | 9/2017 | Machida et al. | |
| 2017/0296014 | A1 * | 10/2017 | Warren | A47L 9/14 |
| 2017/0332864 | A1 * | 11/2017 | Nam | A47L 11/4013 |
| 2018/0116478 | A1 | 5/2018 | Lewis et al. | |
| 2018/0177367 | A1 * | 6/2018 | Amaral | A47L 9/0477 |
| 2019/0298131 | A1 * | 10/2019 | Hu | A47L 9/122 |
| 2020/0178743 | A1 * | 6/2020 | Hu | A47L 9/1409 |

FOREIGN PATENT DOCUMENTS

| | | | |
|---|---|---|---|
| CN | 209450457 | U | 10/2019 |
| CN | 209450458 | U | 10/2019 |
| CN | 209564080 | U | 11/2019 |
| CN | 209915887 | U | 1/2020 |
| EP | 3082539 | | 10/2016 |
| EP | 3485782 | A2 | 5/2019 |
| JP | 49123300 | A | 11/1974 |
| JP | 53102268 | A | 9/1978 |
| JP | H05207185 | A | 8/1993 |
| JP | 6861685 | B2 | 4/2021 |
| WO | 2015090437 | | 6/2015 |
| WO | WO-2019099620 | A1 | 5/2019 |

OTHER PUBLICATIONS

"Japanese Application Serial No. 2018-214430, Notification of Reasons for Refusal mailed Oct. 1, 2019", w/English Translation, 8 pgs.
"Chinese Application Serial No. 201821885711.1, Office Action mailed Jul. 25, 2019", w English summary, 2 pgs.
"Chinese Application Serial No. 201821885480.4, Office Action mailed Aug. 2, 2019", w English summary, 2 pg.
"Chinese Application Serial No. 201821885480.4, Response filed Aug. 9, 2019 to Office Action mailed Aug. 2, 2019", w current English claims, claims not amended, 36 pgs.
"Chinese Application Serial No. 201821885714.5, Notification to Make Rectification mailed Aug. 2, 2019", W English summary, 2 pgs.
"Chinese Application Serial No. 201821885711.1, Response filed Jul. 31, 2019 to Office Action mailed Jul. 25, 2019", w English current claims, claims not amended in response filed, 42 pgs.
"Deebot N79 Instruction Manual," Ecovacs Robotics, [undated], 80 pages.
"ILife User Manual, Robotic vacuum cleaner Model: V7s Pro," available to www.myrobotcenter.com, [undated], 20 pages.
International Search Report and Written Opinion in International Application No. PCT/US2018/61213, dated Jan. 25, 2019, 11 pages.
"International Application Serial No. PCT US2018 061213, International Search Report mailed Jan. 25, 2019", 2 pgs.
"International Application Serial No. PCT US2018 061213, Written Opinion mailed Jan. 25, 2019", 5 pgs.
"European Application Serial No. 18206668.8, Extended European Search Report mailed Jul. 10, 2019", 7 pgs.
"European Application Serial No. 18206668.8, Response filed Feb. 6, 2020 to Extended European Search Report mailed Jul. 10, 2019", 17 pgs.
"Japanese Application Serial No. 2018-214430, Response filed Apr. 7, 2020 to Notification of Reasons for Refusal mailed Oct. 1, 2019", w/ English Claims, 11 pgs.
"Japanese Application Serial No. 2018-214430, Notification of Reasons for Refusal mailed Jul. 27, 2020", w English translation, 8 pgs.
"Chinese Application Serial No. 201811360410.1, Office Action mailed Apr. 14, 2021", w English Translation, 15 pgs.
"European Application Serial No. 21168071.5, Invitation to Remedy Deficiencies (R.58 EPC) mailed Apr. 28, 2021", 1 pg.
"European Application Serial No. 21168071.5, Response filed Jul. 7, 2021 to Invitation to Remedy Deficiencies (R.58 EPC) mailed Apr. 28, 2021", 10 pgs.
"European Application Serial No. 21168071.5, Extended European Search Report mailed Nov. 4, 2021", 4 pgs.
"European Application Serial No. 21168071.5, Communication Pursuant to Article 94(3) EPC mailed Nov. 16, 2021", 5 pgs.

* cited by examiner

WASHABLE BIN FOR A ROBOT VACUUM CLEANER

TECHNICAL FIELD

This disclosure relates to a cleaning bin for a cleaning robot, in particular, a mobile cleaning robot.

BACKGROUND

Cleaning robots include mobile robots that autonomously perform cleaning tasks within an environment, e.g. a home. Many kinds of cleaning robots are autonomous to some degree and in different ways. The cleaning robots can autonomously navigate about the environment and ingest debris as they autonomously navigate the environment. The ingested debris are often stored in cleaning bins that can be manually removed from the cleaning robots so that debris can be emptied from the cleaning bins. In some cases, an autonomous cleaning robot may be designed to automatically dock with evacuation stations for the purpose of emptying its cleaning bin of ingested debris.

SUMMARY

In one aspect, a cleaning bin mountable to an autonomous cleaning robot operable to receive debris from a floor surface includes an inlet positioned between lateral sides of the cleaning bin and an outlet configured to connect to a vacuum assembly, the vacuum assembly operable to direct an airflow from the inlet of the cleaning bin to the outlet of the cleaning bin. The cleaning bin also includes a debris chamber to receive debris from the airflow, an airflow chamber separated from the debris chamber by a prefilter, the prefilter forming at least a portion of a top surface of the debris chamber and at least a portion of a bottom surface of the airflow chamber, and a filter socket configured to receive a filter and provide the airflow to through the filter to the outlet of the cleaning bin, wherein the filter is positioned substantially perpendicular to the prefilter when the filter is positioned in the filter socket.

In some implementations, the cleaning bin is absent exposed metallic components.

In some implementations, the prefilter is welded into position between the debris chamber and the airflow chamber.

In some implementations, the inlet includes a pivotably moveable door. In some instances, the cleaning bin includes a door release latch mechanism for opening the pivotably movable door. In some instances, the door release latch mechanism includes a button positioned in a top surface of the cleaning bin.

In some implementations, the airflow travels from the airflow chamber into a transition portion proximate to the filter socket.

In some implementations, the debris chamber has a volume of between 350 and 500 mL.

In some implementations, the cleaning bin includes a bin attachment hook configured to interface with a socket of the autonomous cleaning robot when inserting and removing the cleaning bin. In some instances, the bin attachment hook has a height of between approximately 35 and 55 mm. In some instances, the bin attachment hook has tapered ends configured to aid in aligning the bin with the autonomous cleaning robot during insertion and removal of the cleaning bin.

In some implementations, the cleaning bin has a curved outer surface complementary to a curved outer surface of a body of the autonomous cleaning robot.

In another aspect, an autonomous cleaning robot includes a body, a drive operable to move the body across a floor surface, a vacuum assembly carried in the body, the vacuum assembly operable to generate an airflow to carry debris from the floor surface as the body moves across the floor surface, and a cleaning bin removably mounted to the body. The cleaning bin includes a debris chamber to receive debris from an airflow, the airflow traveling from an inlet of the cleaning bin to an outlet of the cleaning bin, the airflow created by a vacuum assembly connected to the outlet of the cleaning bin, and an airflow chamber separated from the debris chamber by a prefilter, the prefilter forming at least a portion of a top surface of the debris chamber and at least a portion of a bottom surface of the airflow chamber. The cleaning bin pivots about an axis external to the body of the robot during insertion and removal.

In some implementations, the autonomous cleaning robot includes a bin release latch mechanism for partially ejecting the cleaning bin. In some instances, the bin release latch mechanism includes a bin release latch with a curved surface complementary to a curved surface of the body of the robot. In some instances, the bin release latch mechanism allows for one-handed removal of the cleaning bin.

In some implementations, the cleaning bin includes a bin grip detail on a bottom portion of the cleaning bin.

In some implementations, the cleaning bin includes a door seal to seal a door of the cleaning bin to a bin mid of the cleaning bin and a cleaning head seal to seal a cleaning head of the autonomous cleaning robot to the door of the cleaning bin. In some instances, when inserting the cleaning bin into the autonomous cleaning robot, a sealing force is applied to the door seal and the cleaning head seal.

In some implementations, the cleaning bin is absent exposed metallic components.

In some implementations, the cleaning bin includes a filter socket configured to receive a filter and provide the airflow through the filter to the outlet of the cleaning bin, wherein the filter is positioned substantially perpendicular to the prefilter when the filter is positioned in the filter socket.

In some implementations, the prefilter is welded into position between the debris chamber and the airflow chamber.

In some implementations, the inlet includes a pivotably movable door. In some instances, the autonomous cleaning robot includes a door release latch mechanism for opening the pivotably moveable door. In some instances, the door release latch mechanism includes a button positioned in a top surface of the cleaning bin.

In some implementations, the airflow travels from the airflow chamber into a transition portion proximate to the filter socket.

In some implementations, the debris chamber has a volume of between 350 and 500 mL.

In some implementations, the cleaning bin includes a bin attachment hook configured to interface with a socket of the autonomous cleaning robot when inserting and removing the cleaning bin. In some instances, the hook has a height of between approximately 35 and 55 mm. In some instances, the hook has tapered ends configured to aid in aligning the bin with the autonomous cleaning robot during insertion and removal of the cleaning bin.

In some implementations, the cleaning bin has a curved outer surface complementary to a curved outer surface of a body of the autonomous cleaning robot.

Advantages of the foregoing may include, but are not limited to, the advantages described below and herein elsewhere.

A cleaning bin interfaces with a body of the mobile cleaning robot such that the cleaning bin pivots about an axis that is located external to the body of the mobile cleaning robot. This allows the cleaning bin to form a smooth outer surface with the body of the mobile cleaning robot, without a gap being needed on the outside edge to allow for removing the bin.

Additionally, the cleaning bin can be removed from the body of the mobile cleaning robot with one hand. A bin release latch and a bin grip are positioned such that a user may hold the cleaning bin at the bin grip and simultaneously press the bin release latch such that the cleaning bin is ejected into the user's hand. The user may also reattach the cleaning bin to the body of the mobile cleaning robot with one hand.

The cleaning bin includes a prefilter and a filter disposed approximately perpendicular to one another. This orientation of the prefilter and filter in this way allows for the cleaning bin to have an increased volume with a generally short height. The orientation of the prefilter to the filter allows maximization of the prefilter area, which allows for more optimal airflow.

Furthermore, the cleaning bin has an absence of exposed metallic components. As such, the cleaning bin can be rinsed and/or washed (e.g., machine washed) without exposing metallic components to water and possibly causing rusting or corrosion.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

The present specification relates to a cleaning bin for a mobile cleaning robot. The cleaning bin pivotably detaches from a body of the mobile cleaning robot about a pivot axis that is located external to the body of the mobile cleaning robot. This pivotable detachment allows the cleaning bin to form a continuous outer surface with the body of the mobile cleaning robot and allows a user to easily detach the cleaning bin. The cleaning bin also lacks exposed metallic components, allowing the cleaning bin to be rinsed, or washed, etc. to remove debris from the cleaning bin without significant risk of corrosion.

Figure 1:
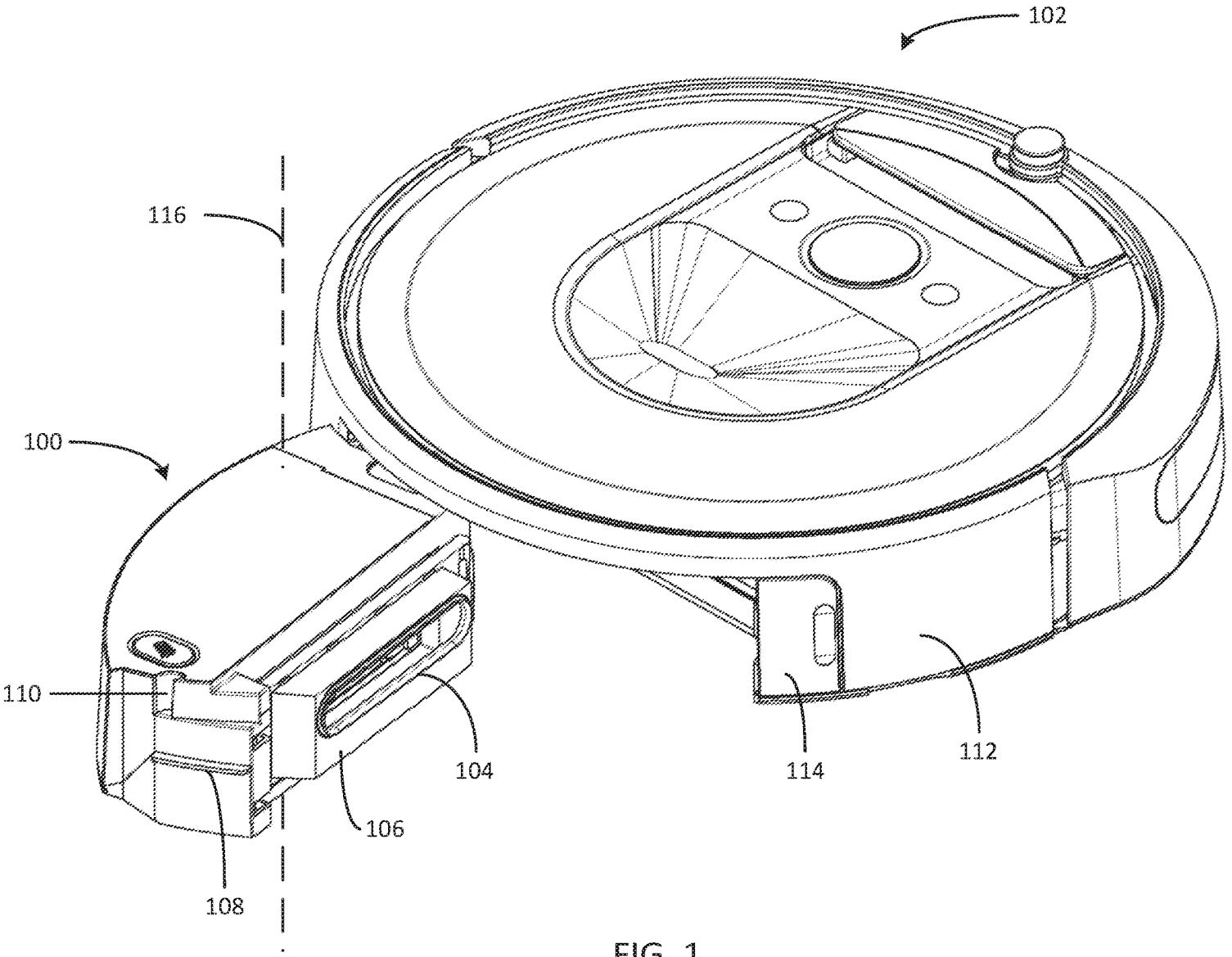
FIG. 1 is a view of a mobile cleaning robot with a washable bin.

Referring to FIG. 1, a cleaning bin 100 is mounted to a mobile cleaning robot 102. The cleaning bin 100 receives debris ingested by the robot 102 during a cleaning operation of a floor surface. The cleaning bin 100 is mounted to a body 112 of the robot 102 during a cleaning operation so that the cleaning bin 100 receives debris ingested by the robot 102 and so that the cleaning bin 100 is in pneumatic communication with a vacuum assembly (not shown) of the mobile cleaning robot 102. During the cleaning operation, the vacuum assembly of the mobile cleaning robot 102 generates an airflow to lift debris from the floor surface, through the cleaning bin 100, and toward the vacuum assembly. The airflow draws the debris from the floor surface through an inlet 104 defined by a door 106 of the cleaning bin 100.

Figure 10B:
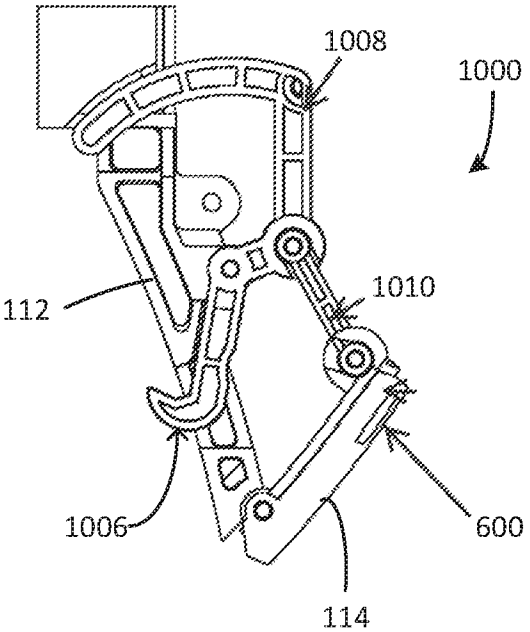
FIG. 10B is a close up view of the bin release latch mechanism of FIG. 10A.
Figure 10A:
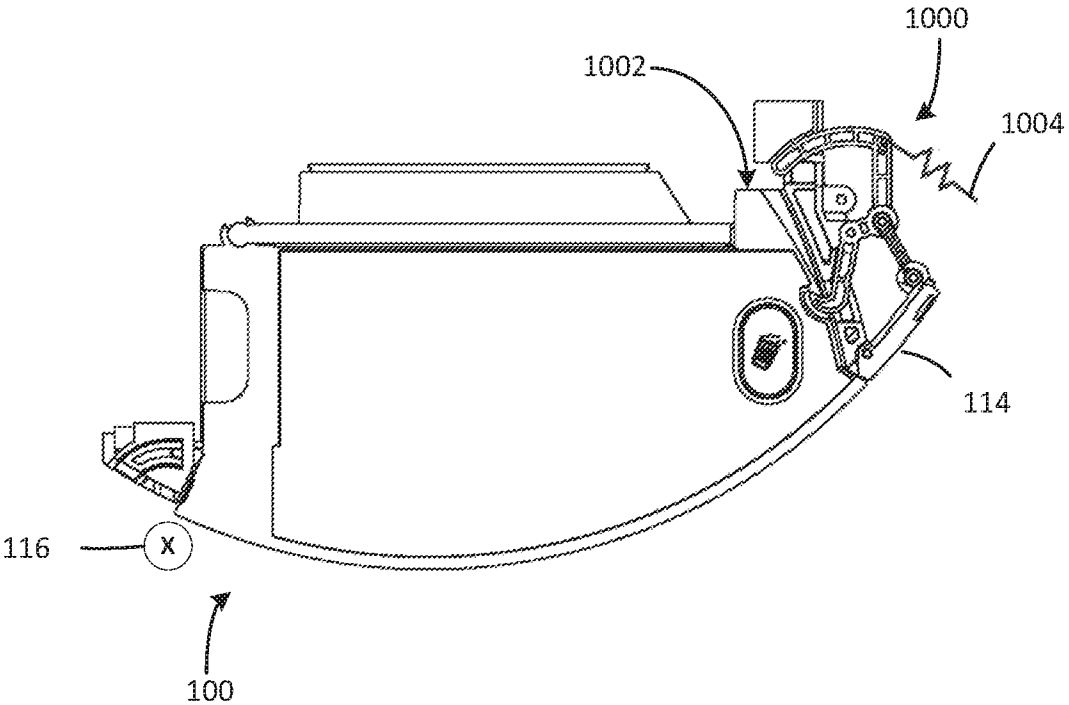
FIG. 10A is a top view of a bin release latch mechanism for mounting the washable bin of FIG. 2A in the mobile cleaning robot.

The cleaning bin 100 has a rail 108 and a notch 110 that interface with the body 112 of the mobile cleaning robot 102 via a bin latch mechanism (shown in FIGS. 10A and 10B). A user can release the cleaning bin 100 from the body 112 of the mobile cleaning robot 102 by pressing the bin release latch 114. When the bin release latch 114 is pressed, the cleaning bin 100 is ejected from the body 112 of the mobile cleaning robot 102 and pivots about an axis 116 that is located external to the body 112 of the mobile cleaning robot 102.

In some cases, the mobile cleaning robot 102 is a self-contained robot that autonomously moves across the floor surface to ingest debris. The cleaning robot 102, for example, carries a battery to power the vacuum assembly.

Figure 2A:
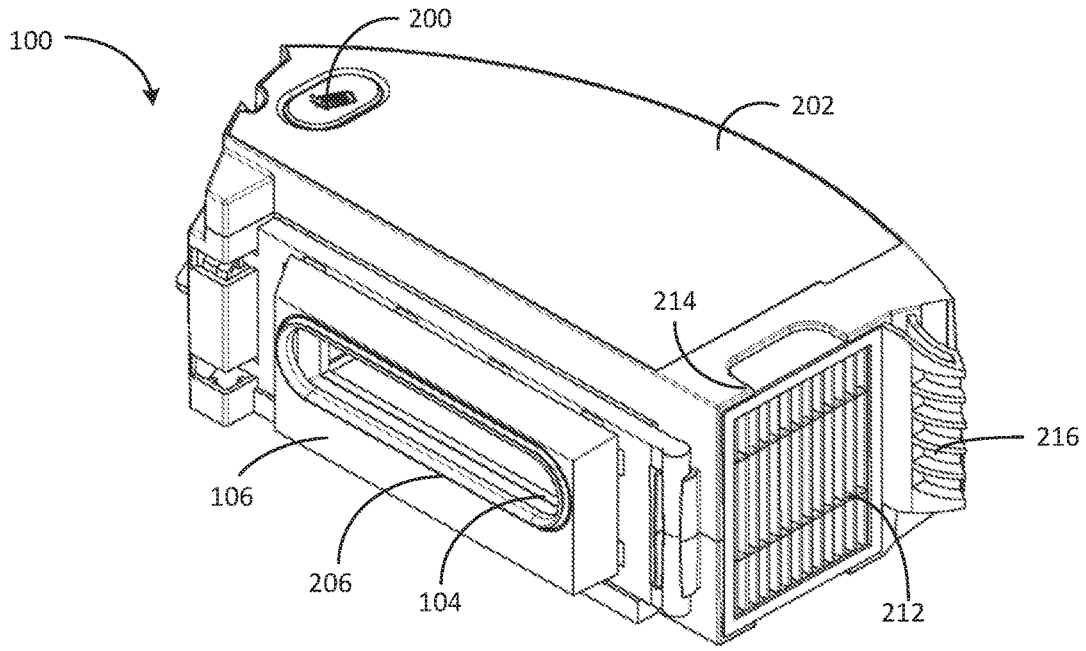
FIG. 2A is a perspective view of the washable bin of FIG. 1.
Figure 2B:
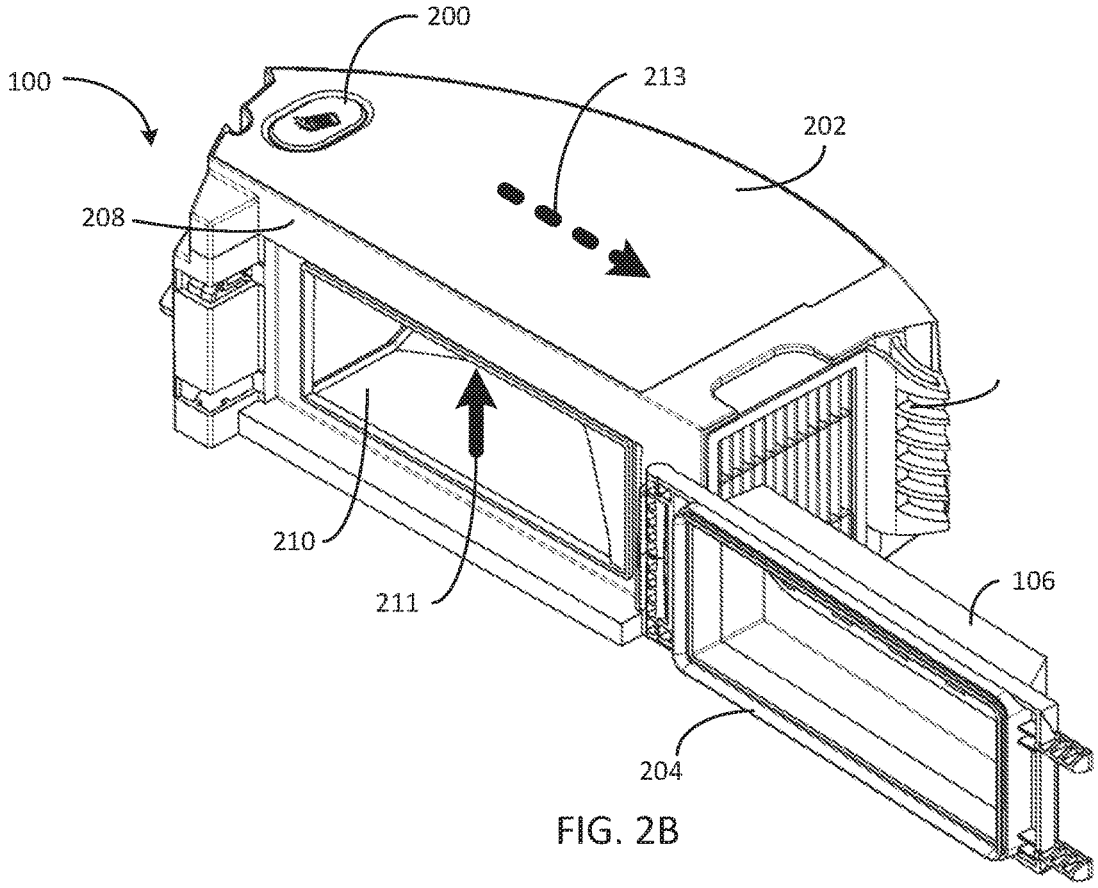
FIG. 2B is a perspective view of the washable bin of FIG. 2A with a door open.

Referring to FIGS. 2A and 2B, the cleaning bin 100 includes the door 106 with the inlet 104 for an airflow passing through the cleaning bin 100. The door 106 is openable by pressing a door release button 200 that is positioned in a top surface 202 of the cleaning bin 100. The door release button 200 is a component of a door release latch mechanism (shown in FIGS. 11, 12A, and 12B) which releases the door 106 upon pressing the door release button 200. The door 106 also includes two seals, a door seal 204 and a cleaning head seal 206. The door seal 204 seals the door 106 to a body 208 of the cleaning bin 100. The cleaning head seal 206 seals the door 106 to a cleaning head (not shown) in the body 112 of the mobile cleaning robot 102 when the cleaning bin 100 is mounted in the body 112 of the mobile cleaning robot.

During a cleaning operation, an airflow passes from the cleaning head (not shown) in the mobile cleaning robot 102 into the inlet 104 in the door 106 of the cleaning bin 100. After passing through the inlet 104, the airflow passes into a debris chamber 210. The airflow flows vertically upward (graphically illustrated by arrow 211) out of the debris chamber 210, through a prefilter (shown in FIG. 3), and into an airflow chamber (shown in FIG. 4). Generally directed as illustrated by arrow 213, the airflow flows through a filter 212 disposed in a filter socket 214 at an outlet of the cleaning bin 100.

The cleaning bin 100 has a bin attachment hook 216 near to the filter socket 214. The bin attachment hook 216 interfaces with a socket (shown in FIGS. 8A-8C) on the body 112 of the mobile cleaning robot 102. The geometry and placement of the bin attachment hook 216 on the cleaning bin allows the pivot axis 116 to be outside of the body 112.

Figure 3:
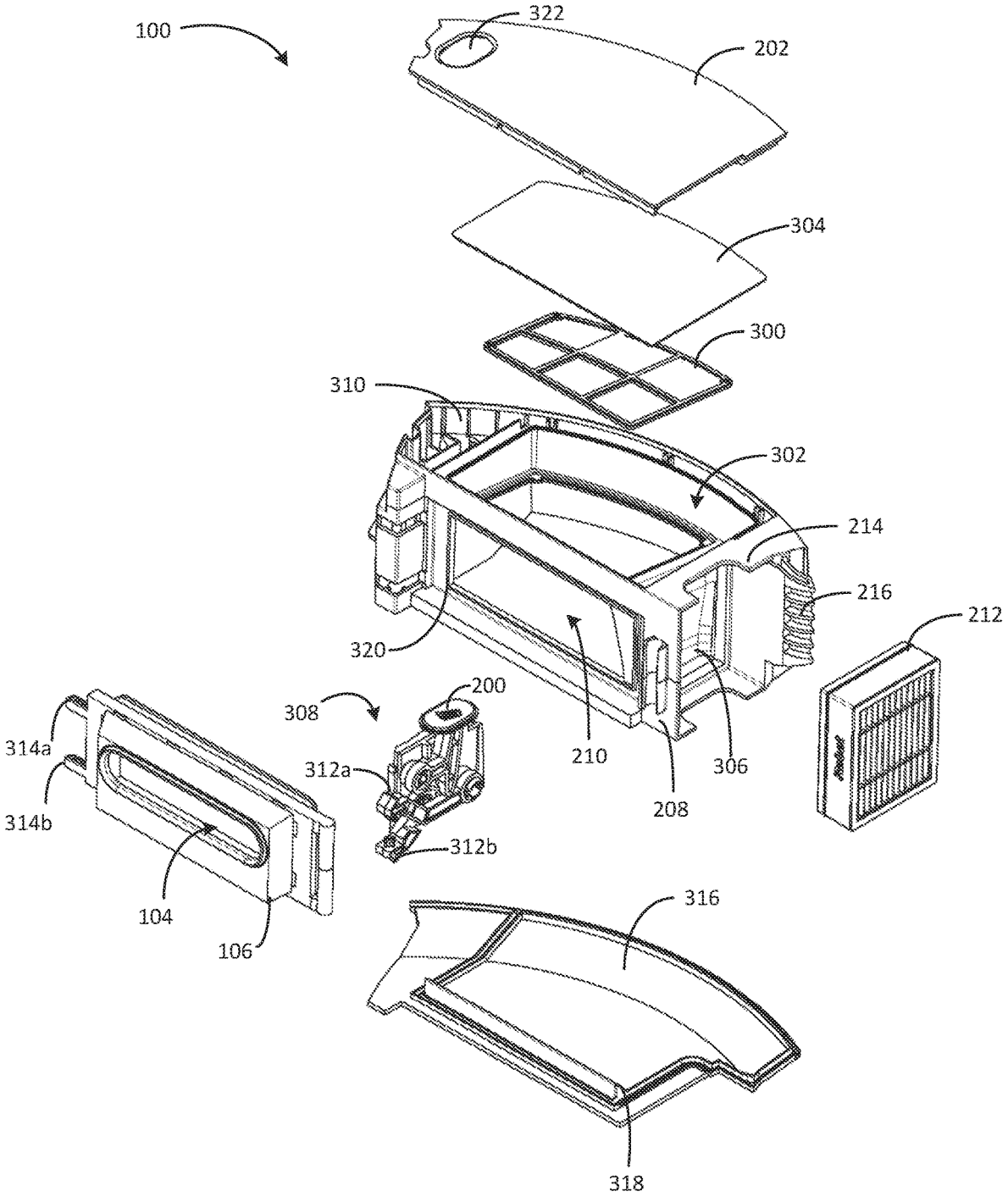
FIG. 3 is an exploded view of the washable bin of FIG. 2A.

FIG. 3 is an exploded view of the cleaning bin 100. Flowing upward from the debris chamber 210, the airflow experiences a prefilter 300 which is positioned horizontally (e.g., substantially parallel to the top 202) in the cleaning bin 100. The prefilter 300 may be welded or otherwise bonded into place. The prefilter 300 separates the debris chamber 210 from an airflow chamber 302 in the bin body 208. The prefilter may have a pore size of approximately 100 to 800 microns (e.g. approximately 580 microns) and prevents debris from entering the airflow chamber 302 in the airflow. A sealing cover 304 mounts to the bin body 208 and forms an upper boundary of the airflow chamber 302. The airflow is vertically delivered from the debris chamber 210 to the prefilter 300 and continues to the sealing cover 304. Pushed horizontally within the airflow chamber 302, the airflow enters a transition portion 306 of the airflow chamber. The transition portion 306 opens to the filter socket 214. The transition portion 306 of the airflow chamber 302 has a height (illustrated as H1 in FIG. 4B) that is larger than a height of the portion of the airflow chamber 302 that is above the debris chamber 210.

In this exploded view, the filter 212 is shown separated from the filter socket 214. Once the filter 212 is positioned in the filter socket 214, the airflow is delivered to the filter 212. The filter 212 has an upstream side facing the airflow channel 302 and a downstream side facing external to the cleaning bin 100. Debris may accumulate on the upstream side of the filter 212. The downstream side is proximate to the vacuum assembly in the body 112 of the mobile cleaning robot 102 when the cleaning bin 100 is mounted in the mobile cleaning robot 102.

The bin body 208 also has a side compartment 310 that houses a door release latch mechanism 308. The door release latch mechanism 308 includes the door release button 200 and latches 312*a* and 312*b*. The latches 312*a* and 312*b* interface with catches 314*a* and 314*b* of the door 106 when the door 106 is closed. The door release latch mechanism 308 includes a metallic spring that biases the door release latch mechanism 308 into a locking position. The top 202 of the cleaning bin 100 covers the side compartment 310 when the cleaning bin 100 is assembled such that the metallic spring of the door release latch mechanism is sealed inside the side compartment 310. A hole 322 in the top 202 presents the button 200. Because the metallic spring is sealed inside the side compartment 310, the cleaning bin 100 may be washed (e.g. exposed to water) without liquid coming into contact with the metallic spring.

A bin bottom 316 also attaches to the bin body 208. The bin bottom 316 forms a bottom of the debris chamber 210. The bin bottom 316 has a ramp feature 318 proximate to an opening 320 in the bin body 208, which is covered by the door 106 when the door 106 is in the closed position. The ramp feature 318 helps to provide for a smoother airflow and less dead space beneath the inlet 104 in the door 106 in which debris may gather. For example, when a user removes the cleaning bin 100 from the body 112, and opens the door 106 to dispose of debris that has collected in the debris chamber 210 during a cleaning operation, the ramp feature allows the debris to slide out of the opening 320 without getting caught.

Figure 4A:
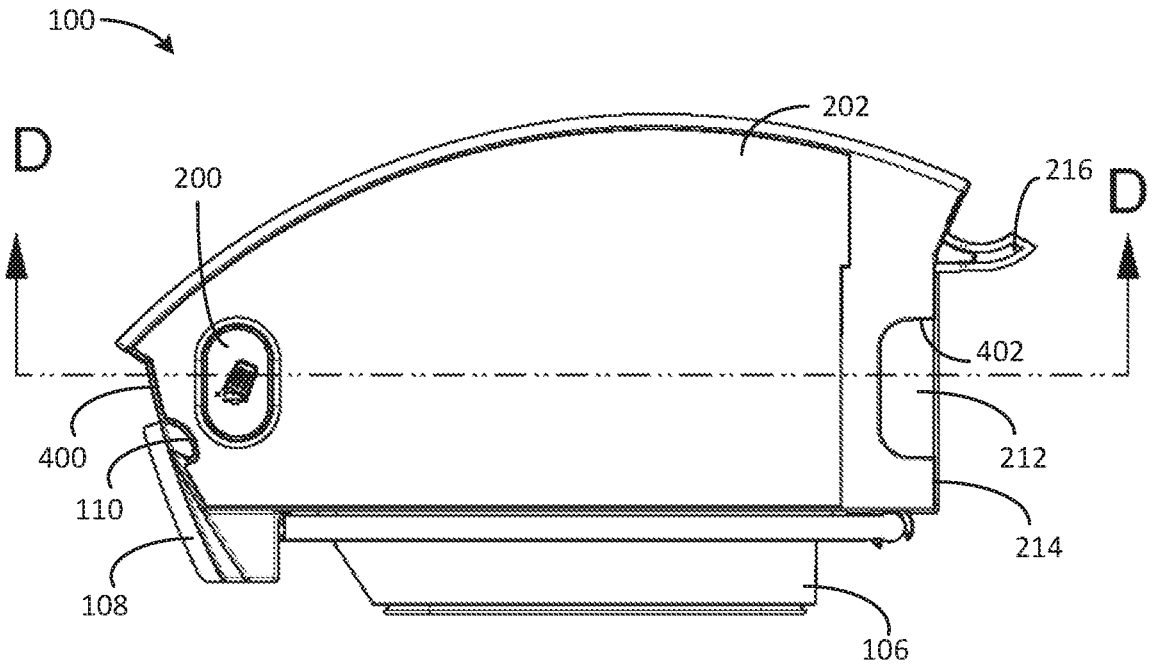
FIG. 4A is a top view of the washable bin of FIG. 2A.
Figure 4B:
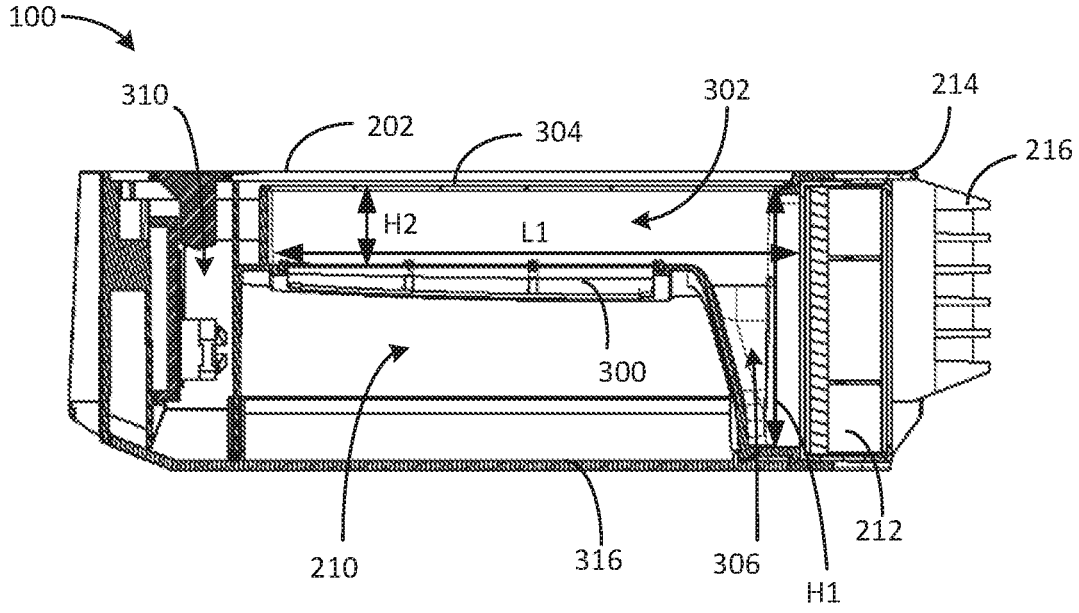
FIG. 4B is a cutaway view of the washable bin of FIG. 2A along axis D-D.

FIG. 4A is a top view of the cleaning bin 100. From this perspective, the bin top 202 is viewable along with upper surfaces of the door 106 and the filter socket 214. An axis D-D cuts across the cleaning bin 100 from the filter socket 214 to a side 400 of the cleaning bin that includes the rail 108 and the notch 110. FIG. 4B is a cross-sectional view of the cleaning bin along the axis D-D. Referring to FIG. 4B, the debris chamber 210 for collecting debris from the airflow is shown and has a volume of approximately 350 to 500 mL (e.g., approximately 405 mL). The debris chamber 210 is separated from the airflow channel 302 by the prefilter 300. The airflow channel 302 includes the transition portion 306 that vertically extends downward to create an opening to the filter 212. The airflow channel 302 has a volume of approximately 70 to 200 mL (e.g., approximately 165 mL) The airflow channel 302 has a height (shown as H2) of approximately 13 to 20 mm (e.g., approximately 17 mm) and a length (shown as L1) of approximately 75 to 150 mL (e.g., approximately 110 mm. The transition portion 306 of the airflow channel 302 has a cross sectional geometry approximately equal to the cross sectional geometry of the filter 212. In the transition portion 306, fine particulates that have passed with the airflow through the prefilter 300, may separate from the airflow and collect in the transition portion 306 before reaching the filter 212.

The prefilter 300 is positioned horizontally (e.g. approximately parallel to the bin top 202 and the bin bottom 316) between the debris chamber 210 and the airflow channel 302. The filter 212 is positioned vertically (e.g. approximately perpendicular to the bin top 202 and bin bottom 316) in the filter socket 214. The filter 212 is removable from the filter socket 214. The filter socket 214 has a first cutout 402 such that a user can grab the filter 212 and remove it from the filter socket 214. In some examples, the filter socket 214 may have multiple cutouts to provide access to the filter 212 for removal. In some examples, the filter 212 or filter socket 214 may have a pull tab or grip detail to allow for removal of the filter 212.

Figure 5A:
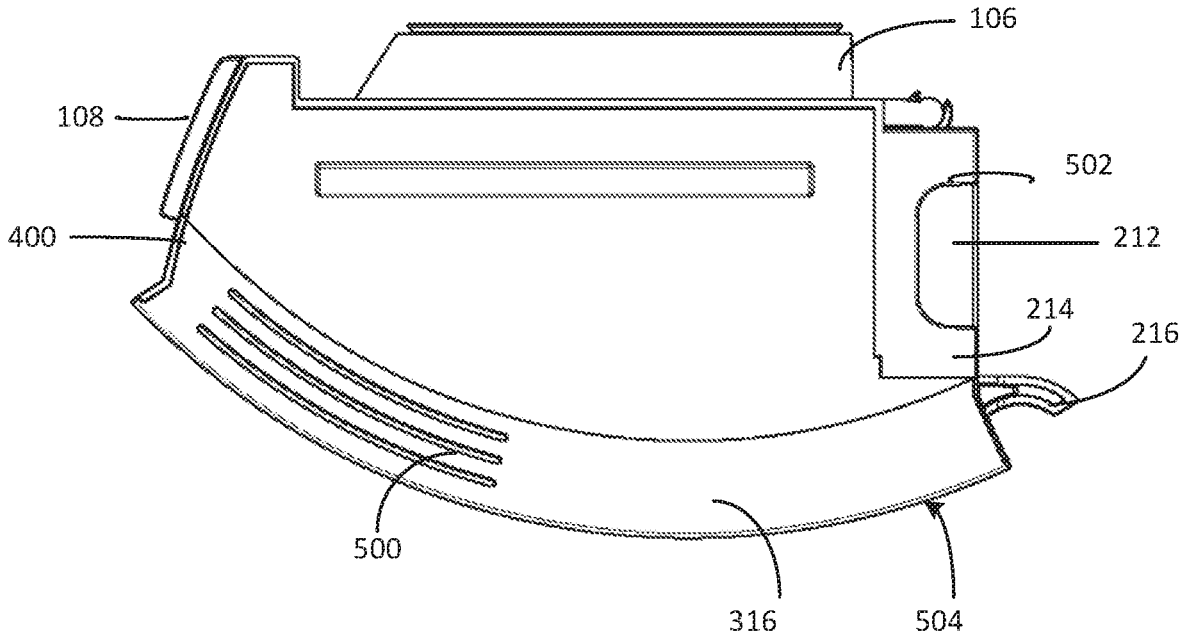
FIG. 5A is a bottom view of the washable bin of FIG. 2A.

FIG. 5A is a bottom view of the cleaning bin 100 and shows the bin bottom 316 including a bin grip feature 500. The bin grip feature 500 is rather eye catching to indicate to a user to grasp the cleaning bin 100 at the bin grip feature 500. Additionally, the bin grip feature can include a tactile feature to assist the user with gripping the cleaning bin 100.

In the present embodiment, the bin grip feature 500 includes a series of three ridges. The grip feature 500 is located on the bin bottom 316 proximate to the side surface 400 that interfaces with the body 112 next to the bin release latch 114. When the cleaning bin 100 is mounted in the mobile cleaning robot 102, the bin grip feature 500 is proximate to the bin release latch 114 (as shown in FIG. 1). As such, the user can hold the cleaning bin 100 at the bin grip feature 500 and press the bin release latch 114 all with one hand. Additionally, the filter socket 214 includes a second cutout 502 to provide access to the filter 212 for easy removal from the cleaning bin 100.

Figure 5B:
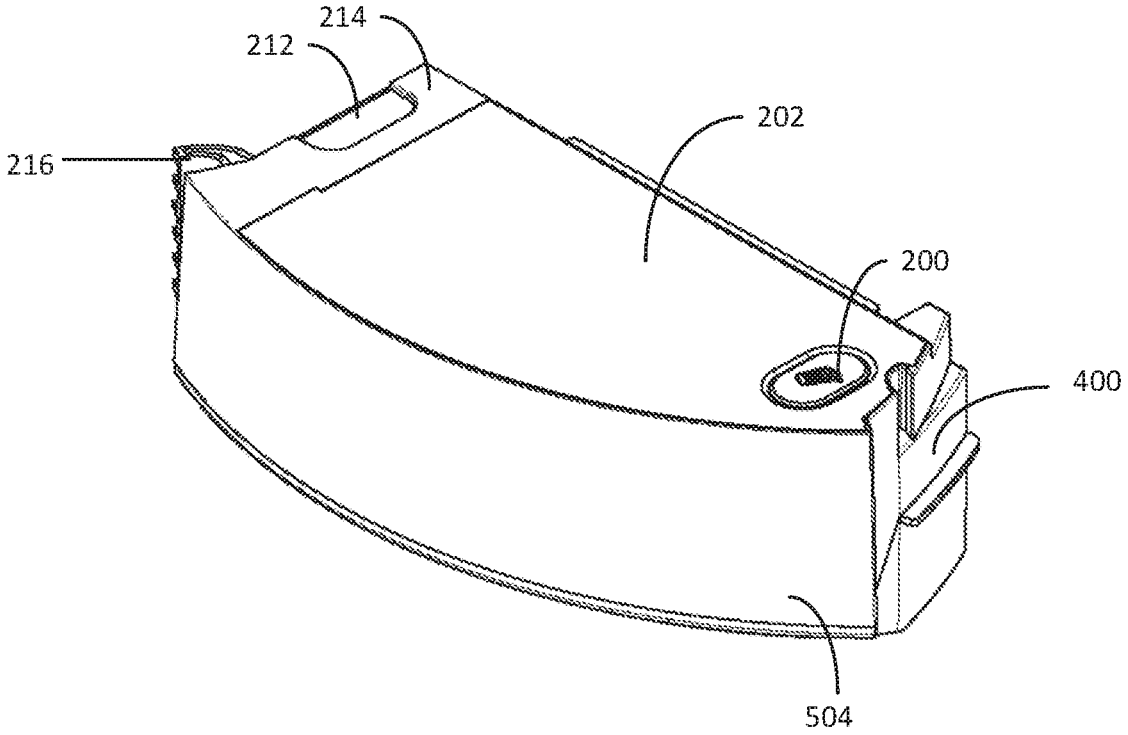
FIG. 5B is a back perspective view of the washable bin of FIG. 2A.

FIG. 5B is a rear perspective view of the cleaning bin 100. The cleaning bin 100 includes a rear external surface 504 that has a curved geometry that allows the cleaning bin 100, when the bin 100 is inserted into the body 112, to form a continuous surface with the mobile cleaning robot 102. When the cleaning bin 100 is inserted, the cleaning bin 100 forms a portion of a cylindrical shape of the mobile cleaning robot 102.

The hook 216 has an opposite orientation to the curvature of the rear external surface 504. Referring back to FIG. 4A, the hook has an upward arc away from axis D-D, whereas the rear external surface 504 has a downward arc toward axis D-D. The opposing curvature of the hook 216 and the rear external surface 504, allows the pivot axis (as shown in FIG. 1) to be external to the body 112.

Figure 6:
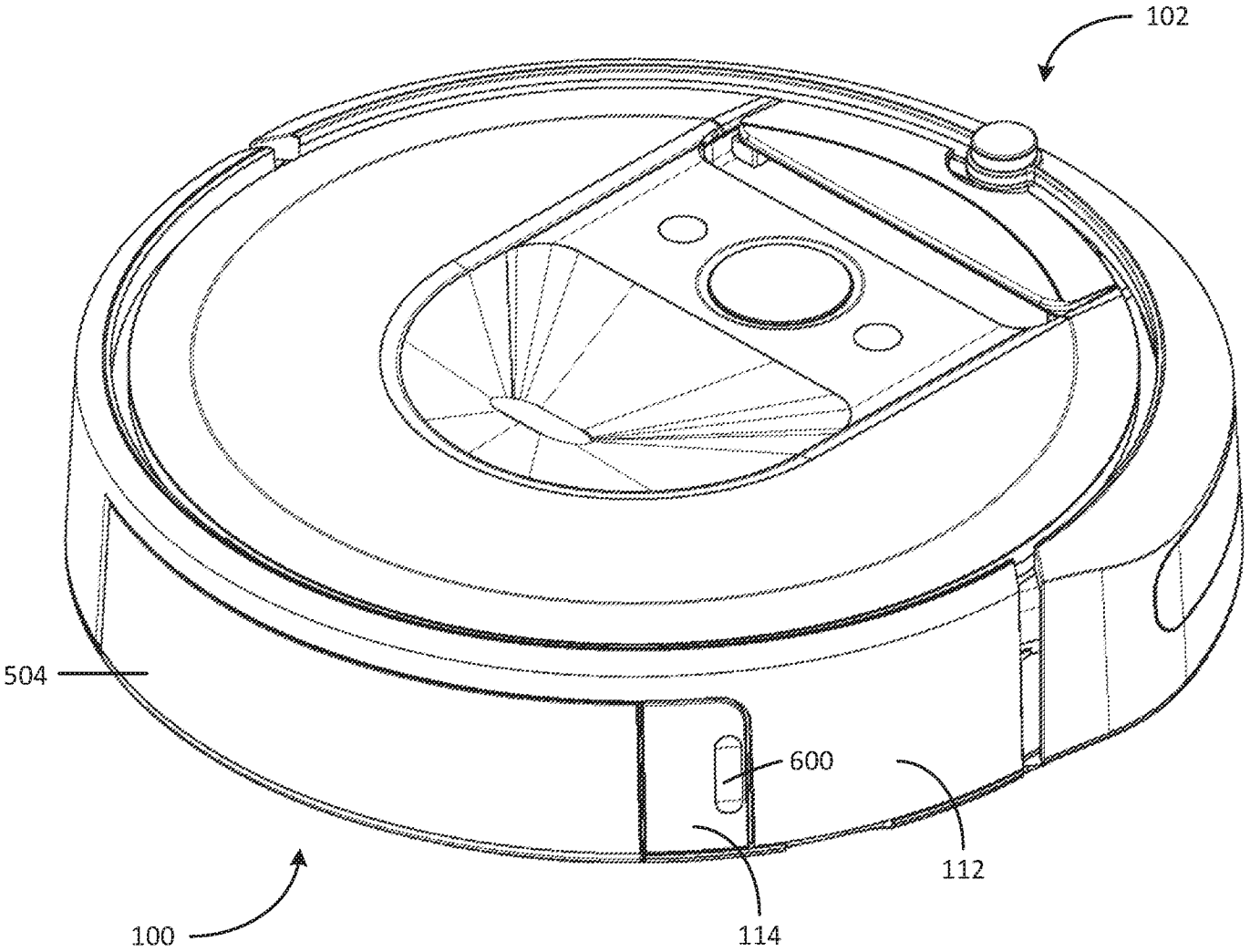
FIG. 6 is a perspective view of the mobile cleaning robot of FIG. 1 with the washable bin mounted in the mobile cleaning robot.

In FIG. 6, the cleaning bin 100 is mounted in the mobile cleaning robot 102. The rear exterior surface 504 of the cleaning bin forms a continuous surface with the body 112 of the mobile cleaning robot 102. The bin release latch 114 also forms a portion of the continuous surface of the mobile cleaning robot 112 and includes an indentation 600. The indentation 600 indicates to a user where to press the bin release latch 114 to release the cleaning bin 100. In some embodiments, the indentation 600 may be replaced with one or more other types of surface features or graphic treatments.

Figure 7:
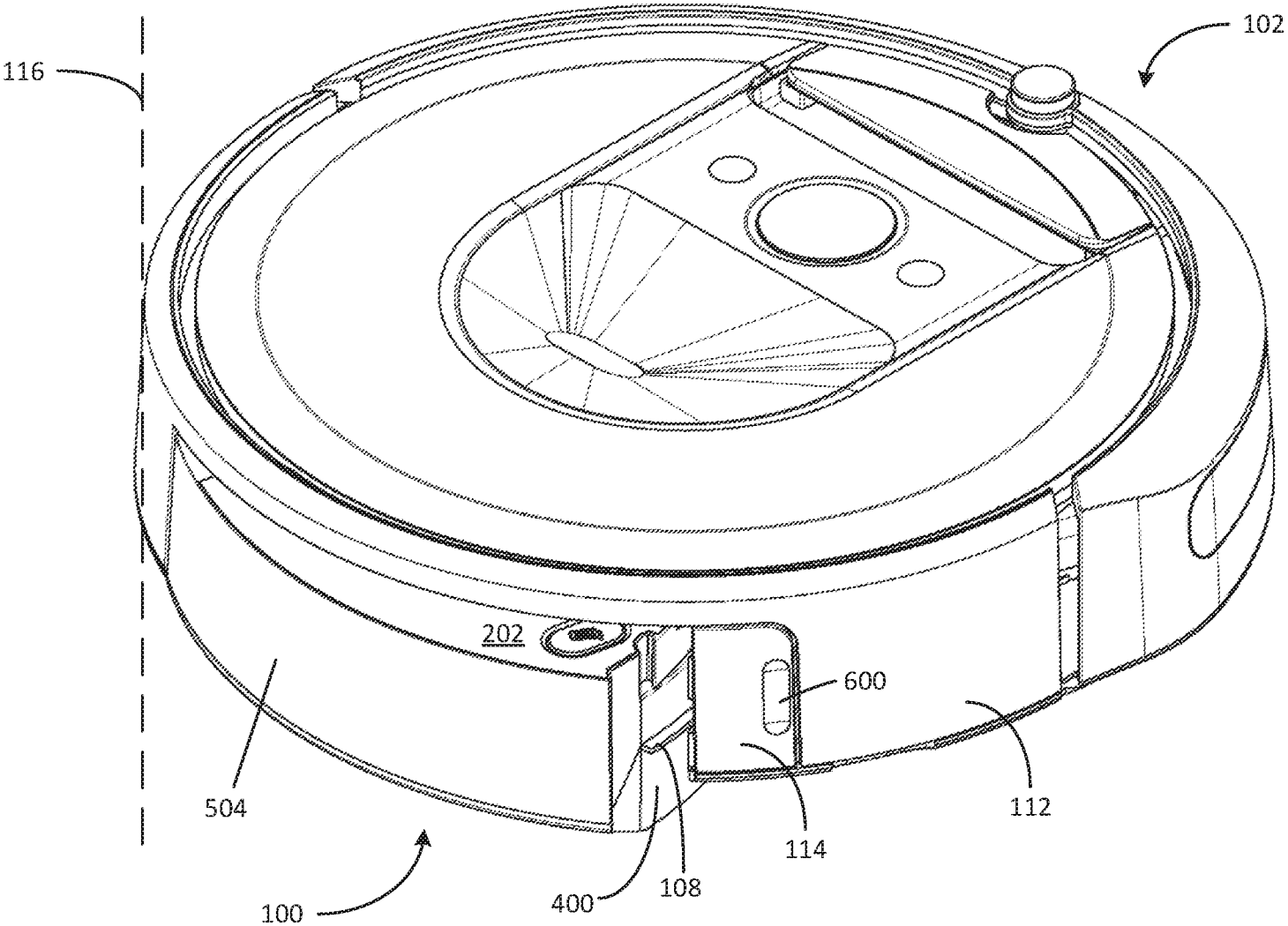
FIG. 7 is a perspective view of the mobile cleaning robot of FIG. 1 as the washable bin is ejected from the mobile cleaning robot.

In FIG. 7, the cleaning bin 100 is released from the body of the mobile cleaning robot 102. Upon pressing the bin release latch 114, a bin release latch mechanism (not shown) unlocks the cleaning bin 100 from being mounted in the body 112 and ejects the cleaning bin 100. The portion of the cleaning bin 100 near to the bin release latch 114 protrudes from the mobile cleaning robot 102 as the cleaning bin 100 pivots about axis 116. A portion of the cleaning bin 100 near to the bin release latch 114 extends furthest from the body 112 of the mobile cleaning robot 102 during the pivoting motion. The cleaning bin 100 rotates through an arc of approximately 45 to 65 degrees (e.g. approximately 55 degrees) before the cleaning bin 100 decouples from the mobile cleaning robot 102. The rail 108 interfaces with the body 112 of the mobile cleaning robot 102 to keep the cleaning bin 100 level as it is removed from the body 112 of the mobile cleaning robot 102.

Figure 8C:
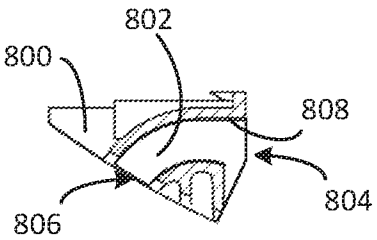
FIG. 8C. is a cutaway view of the bin attachment hook socket of FIG. 8A along axis X-X.
Figure 8B:
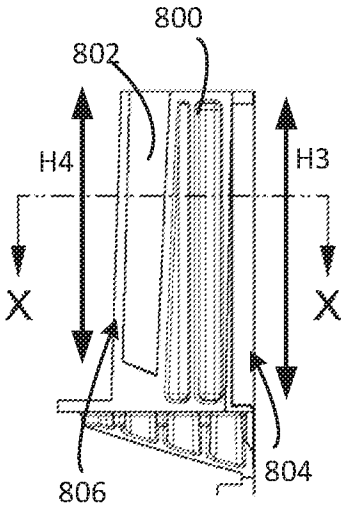
FIG. 8B is a side view of the bin attachment hook socket of FIG. 8A.
Figure 8A:
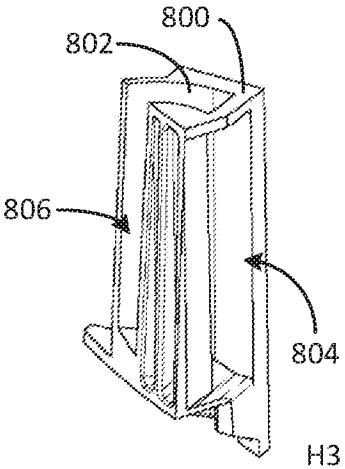
FIG. 8A is a perspective view of a bin attachment hook socket of the mobile cleaning robot of FIG. 1 that receives a bin attachment hook of the washable bin.

FIG. 8A is a perspective view of a socket-defining piece 800 that forms a socket 802 for receiving the bin attachment hook 216 of the cleaning bin 100. The socket-defining piece 800 is a portion of the body 112 and is positioned in the body 112 near an exterior surface of the body 112 opposite the bin release latch 116. FIG. 8B is a side view of the socket-defining piece 800 and FIG. 8C is cross section of the socket-defining piece 800 along axis X-X shown in FIG. 8B. The socket 802 has a curved shape and is configured to receive the curved hook 216 of the cleaning bin 100.

As shown in FIG. 8B, the socket 802 tapers vertically from a mouth 804 (at which it has a height H3) to an end 806 (at which it has a height H4) such that the socket 802 is taller at the mouth 804 than at the end 806. The height H3 of the mouth 804 is larger than a height of the bin attachment hook 216, which is approximately 35 to 55 mm (e.g. approximately 48 mm). The hook 216 is inserted into the socket 802 at the mouth 804 and proceeds toward the end 806 of the socket. As shown in FIG. 8C, the mouth 804 has a wider opening than the end 806 of the socket to allow the hook 216 to self-align. As the hook 216 catches in the socket 802 as the cleaning bin 100 is pivoted into the body 112, this self-alignment levels the cleaning bin 100 with the body 112 so that the bin 100 may latch properly into place. Upon insertion of the hook 216 in the mouth 804 of the socket 802, the hook 216 may contact, and slide along, a ledge 808 that forms a portion of the socket 802. The height of the socket 802 and the hook 216 are more than half of the height of the cleaning bin 100 (or a substantial height compared to the height of the bin). The height ratio between the hook 216, the socket 802, and the cleaning bin 100 allows for some wiggle room in pivoting the cleaning bin 100 in and out of the body 112 of the mobile cleaning robot 102, but does not allow too much movement such that the user can misalign the bin if the hook 216 and the socket 802 are interfaced.

Figure 9:
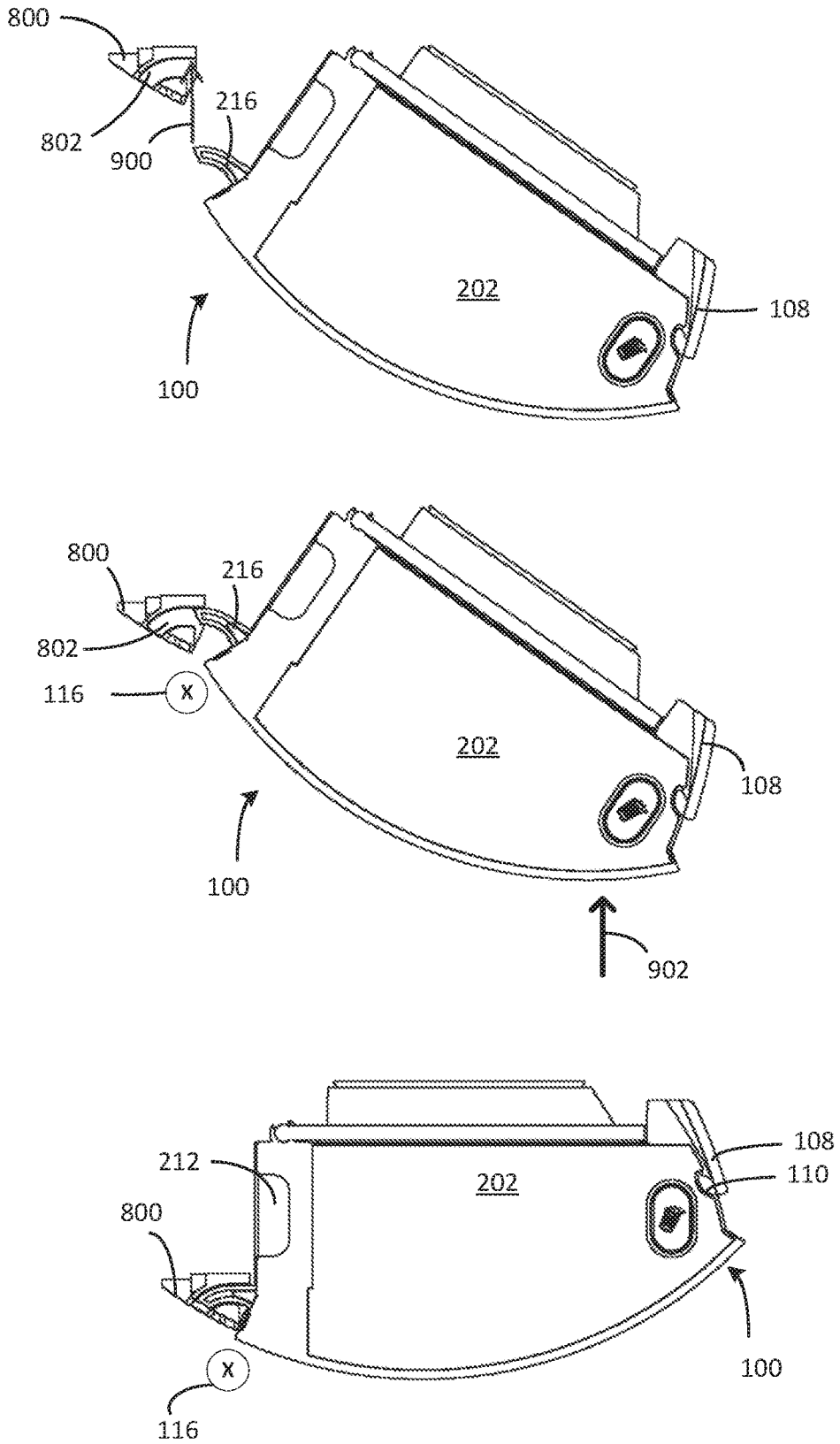
FIG. 9 are images that illustrate inserting a bin attachment hook of the washable bin of FIG. 2A into the bin attachment hook socket of FIGS. 8A-8C.

FIG. 9 are images that illustrate inserting the bin attachment hook 216 of the cleaning bin 100 of FIG. 1 into the socket 802 of FIGS. 8A-8C. First, a user moves the cleaning bin 100 into the opening in the body 112, as shown by arrow 900. This movement positions the hook 216 of the cleaning bin 100 proximate to or in contact with the mouth 804 (as shown in FIGS. 8A-8C) of the socket 802. The hook 216 may come into contact with the ledge 808 (as shown in FIG. 8C), stopping the hook 216 from moving past the socket 802 in the body 112. Next, the user pivots the cleaning bin 100 about axis 116, as shown by arrow 902, which pushes the hook 216 further into the socket 802. During the pivoting motion, the rail 108 may come into contact with the body 112 to further align the cleaning bin 100. The cleaning bin 100 slides into place and pivots inward as the hook 216 slides further into the socket 802. Upon completing the pivoting motion, the cleaning bin 100 is locked into a mounted position in the body 112 of the mobile cleaning robot 102 at notch 110. The notch 110 interfaces with a bin release latch mechanism of the mobile cleaning robot, as further discussed below.

FIG. 10A is a top view of a bin release latch mechanism 1000 for mounting the cleaning bin 100 in the mobile cleaning robot 102 of FIG. 1. FIG. 10B is a close up view of the bin latch mechanism 1000 in a locked position. The cleaning bin 100 has a vertical surface 1002 for interfacing with the bin release latch mechanism 1000. As shown in FIG. 10B, a force is applied by the bin release latch mechanism 1000 to the vertical surface 1002 to eject the cleaning bin 100 from the body 112 of the mobile cleaning robot 102. The bin release latch mechanism 1000 includes a return spring 1004 that biases the bin release latch mechanism 1000 in a locked position. As shown in FIG. 10B, the bin latch mechanism 1000 has two arms, a claw arm 1006 and a ejector 1008. The claw arm 1006 and the ejector 1008 are linked to the bin latch button 114 by a linkage 1010.

In the locked position, as shown in FIGS. 10A and 10B, the claw arm 1006 extends through the body 112 and interfaces with the notch 110 of the cleaning bin 100 if the cleaning bin 100 is present in the body 112. If the cleaning bin 100 is not present in the opening of the body 112, the claw arm 1006 extends through the body 112 of the mobile cleaning robot into the opening in the body 112 that receives the cleaning bin 100. Upon insertion, the cleaning bin 100 pushes past the claw arm 1006 as it is inserted into the body 112. When the notch 110 of the cleaning bin 100 reaches the claw arm 1006 of the bin latch mechanism 1000, the claw arm 1006 interfaces with the notch 110 to lock the cleaning bin 100 with the body 112. The ejector 1008 of the bin latch mechanism 1000 is recessed inside a portion of the body 112.

Figure 10D:
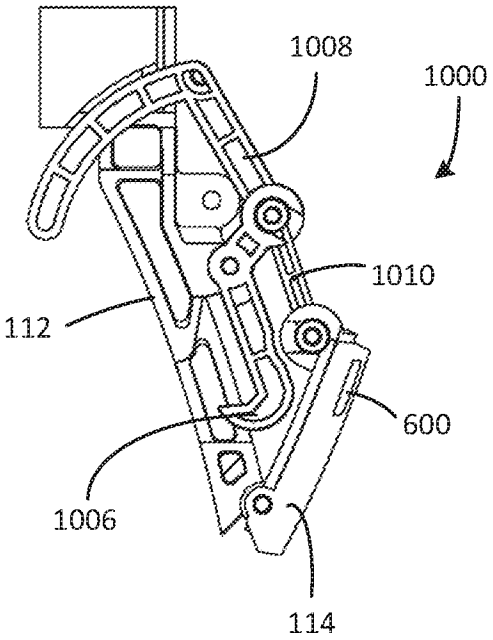
FIG. 10D is a close up view of the bin release latch mechanism of FIG. 10C.
Figure 10C:
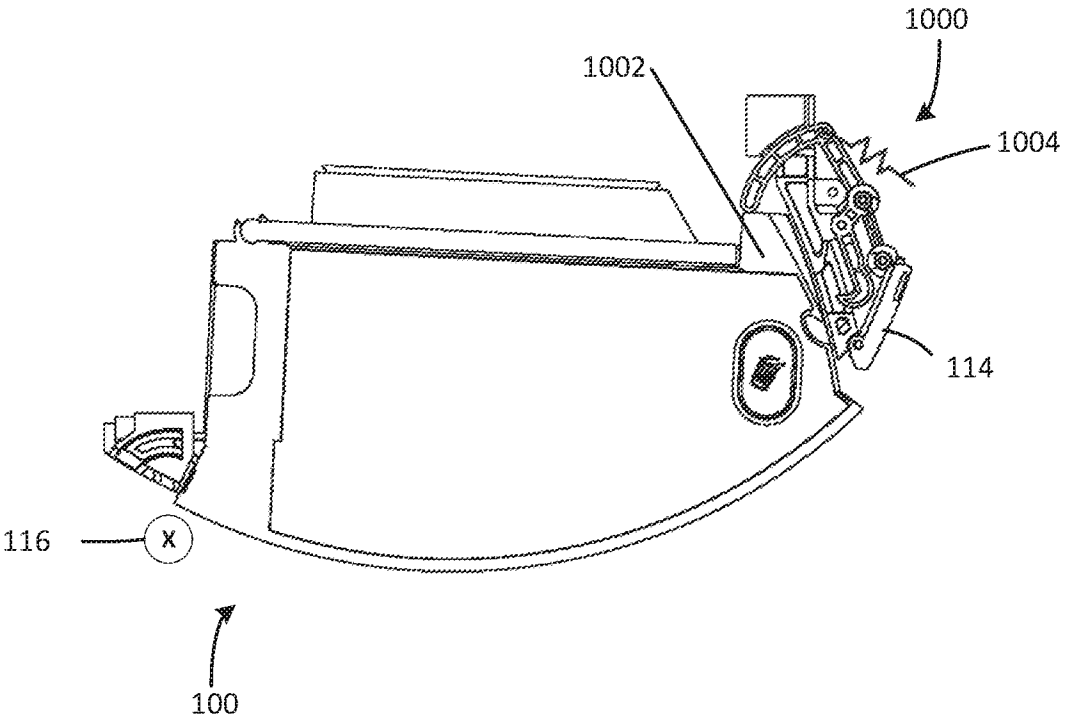
FIG. 10C is a top view of a bin release latch mechanism for releasing the washable bin from the mobile cleaning robot of FIG. 1.

FIG. 10C is a top view of the bin release latch mechanism 1000 in a released position interfacing with the cleaning bin 100. FIG. 10D is a closet up view of the bin release latch mechanism 1000. When the bin latch button 114 is pressed, the bin latch button 114 transfers force onto the linkage 1010 which forces the ejector 1008 of the bin latch mechanism 1000 into the vertical surface 1002 of the cleaning bin 100 and pulls the claw arm 1006 out of the notch 110 on the cleaning bin 100. Therefore, the contact of the ejector 1008 on the vertical surface 1002 of the cleaning bin 100 causes the cleaning bin 100 to begin to pivot outward, about axis 116, from the body 112. The cleaning bin 100 follows the pivot motion about axis 116 because the hook 216 must follow the curvature of the socket 802, causing the pivoting motion. After the cleaning bin 100 has been ejected, the ejector 1008 is pulled back into the portion of the body 112, the claw arm 1006 protrudes back into the opening in the body 112, and the bin latch button 114 returns to a position flush with an external surface of the body 112.

Figure 11B:
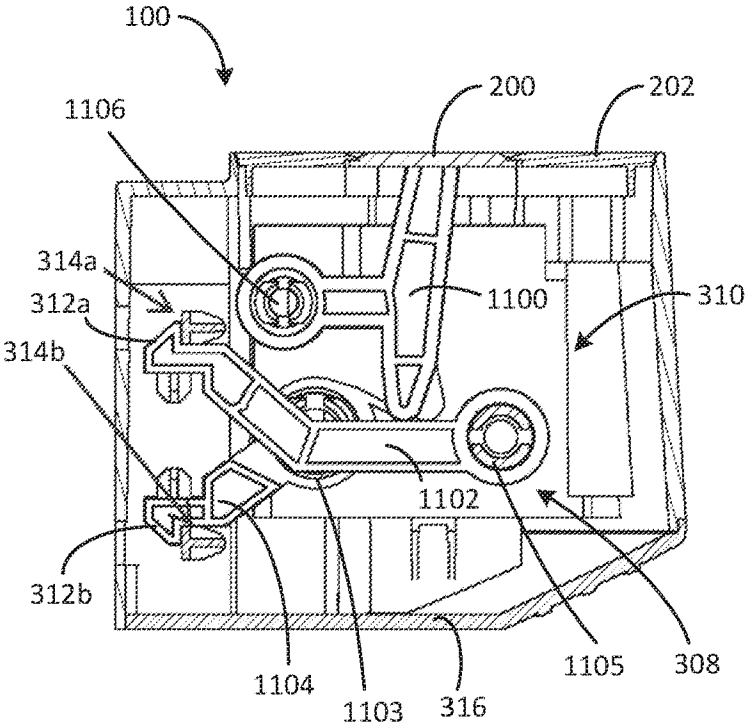
FIG. 11B is a cutaway view of the washable bin of FIG. 11A along axis X-X.
Figure 11A:
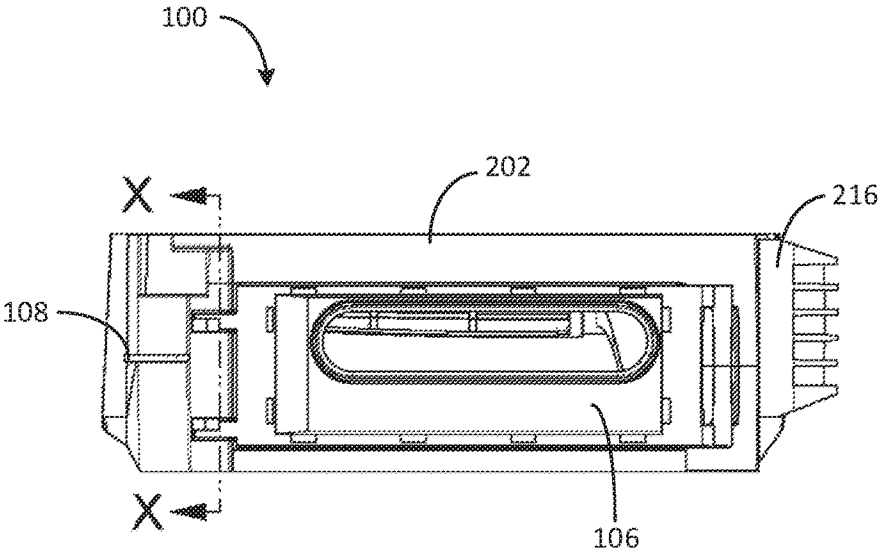
FIG. 11A is a side view of the washable bin of FIG. 1.

Referring to FIGS. 11A and 11B, the door release latch mechanism 308 is disposed in the side compartment 310 of the cleaning bin 100. A slice through the side compartment 310 is shown by axis X-X in FIG. 11A and the cross-sectional view along axis X-X is displayed in FIG. 11B. The button 200 of the door release latch mechanism 308 is connected to a button arm 1100 that interfaces with an upper arm 1102 and a lower arm 1104. As the button arm 1100 moves downward, pivoting about an upper pivot 1106, the he upper arm 1102 pivots about a first lower pivot 1105 and moves downward and a lower arm 1104 pivots about a second lower pivot 1103 and moves upward. This movement brings the upper arm 1102 and the lower arm 1104 closer together such that latches 312*a* and 312*b*, on the upper arm 1102 and lower arm 1104 respectively, can pass by the door. The latches 312*a* and 312*b* have angled outside edges and rear-facing vertical faces. The angled outside edges allow catches 314*a* and 314*b* on the door 106 to slide past the latches 312*a* and 312*b* as the door is closed or opened. The catches 314*a* and 314*b* then interface with the rear-facing vertical faces, which holds the door 106 locked in place.

Figure 12B:
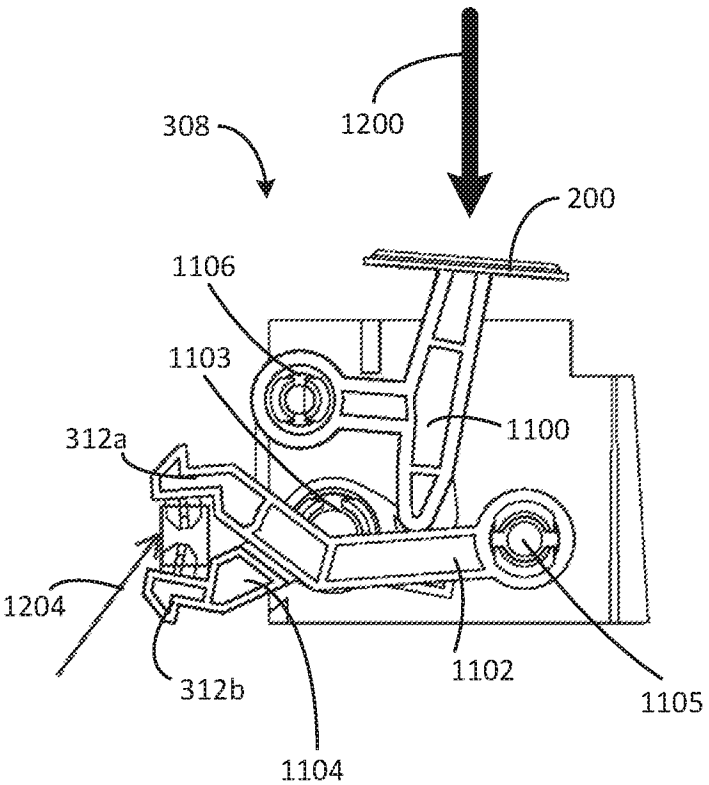
FIG. 12B is a view of the door release latch mechanism of FIG. 11B in an unlatched position.
Figure 12A:
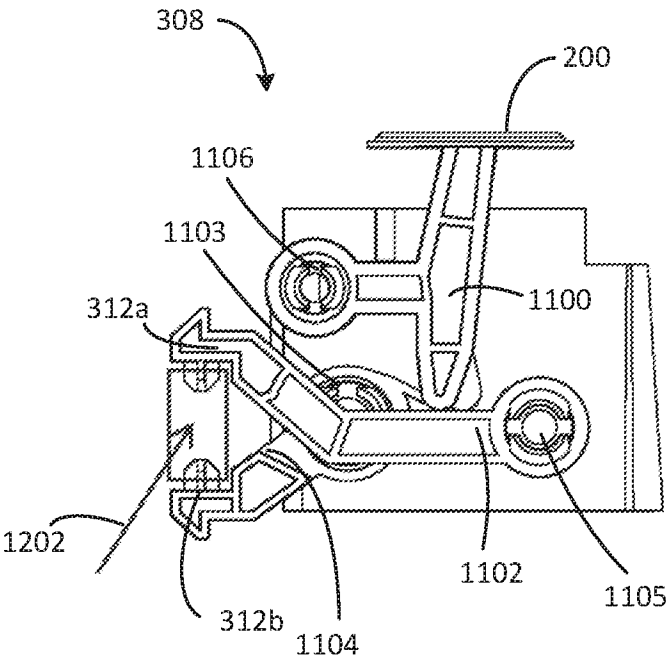
FIG. 12A is a view of the door release latch mechanism of FIG. 11B in a latched position.

Referring to FIGS. 12A and 12B, the latches 312*a* and 312*b* of the door release latch mechanism 308 change position relative to one another depending on whether the button 200 is depressed. An internal spring (not shown) biases the door release latch mechanism 308 into the door-locking position shown in FIG. 12A where the latches 312*a* and 312*b* are farther apart from one another than when the button 200 is depressed. The latches 312*a* and 312*b* are in this farther apart configuration when the door 106 is locked in place or fully open. When the button 200 is depressed, as shown in FIG. 12B, e.g. when the door is in the process of being locked or opened, the latches 312*a* and 312*b* are closer together, as indicated by the difference in spacing shown by arrows 1202 and 1204.

The internal spring may be metallic or elastomeric. The internal spring may also be a molded geometry of a plastic portion of the bin itself. In some implementations, where the internal spring is metallic, the internal spring may be the only metallic component of the cleaning bin 100. As a metallic internal spring is located in the door release latch mechanism 308, which is located in the side compartment 310 of the cleaning bin 100, the cleaning bin 100 may be easily rinsed or washed (e.g. machine washed) to remove debris without worrying about corrosion of the metallic internal spring.

When opening the door 106, as shown in FIG. 12B, a user presses the button 200 (signified by arrow 1200) and the button arm 1100 moves downward. The button arm 1100 presses on the upper arm 1102, which causes the latch 312*a* on the end of the upper arm 1102 to be pulled downward. The upper arm 1102 interfaces with the lower arm 1104 at pivot 1103. As such, when the upper arm 1102 is pressed downward, the lower arm 1106, and therefore catch 312*b*, is pulled upward. Latches 312*a* and 312*b* are pulled downward and upward, respectively, such that the catches 314*a* and 314*b* of the door 106 may pass outside of the latches 312*a* and 312*b*. This motion unlocks the door 106 and allows the door 106 to swing open.

Other latching mechanisms may be used to latch and unlatch the door of the cleaning bin, or to eject the cleaning bin from the body of the mobile cleaning robot. Accordingly, other embodiments are within the scope of the following claims A number of embodiments of the invention have been described. Nevertheless, it will be understood that various modifications may be made without departing from the spirit and scope of the invention. For example:

What is claimed is:

1. A cleaning bin mountable to an autonomous cleaning robot operable to receive debris from a floor surface, the cleaning bin comprising:

an inlet positioned between lateral sides of the cleaning bin;

an outlet located on one of the lateral sides, the outlet configured to connect to a vacuum assembly, the vacuum assembly operable to direct an airflow from the inlet of the cleaning bin to the outlet of the cleaning bin;

a debris chamber to receive debris from the airflow;

an airflow chamber separated from the debris chamber by a prefilter, the prefilter forming at least a portion of a top surface of the debris chamber and at least a portion of a bottom surface of the airflow chamber; and a filter socket located at the outlet of the cleaning bin and configured to receive a filter and provide the airflow to flow through the filter to the outlet of the cleaning bin, wherein the filter is positioned substantially perpendicular to the prefilter when the filter is positioned in the filter socket;

wherein the cleaning bin is releasably connected to the autonomous cleaning robot to provide user-separability of the cleaning bin from the vacuum assembly.

2. The cleaning bin of claim 1, wherein the cleaning bin is absent exposed metallic components.

3. The cleaning bin of claim 1, wherein the prefilter is welded into position between the debris chamber and the airflow chamber.

4. The cleaning bin of claim 1, wherein the inlet includes a pivotably moveable door.

5. The cleaning bin of claim 4, comprising a door release latch mechanism for opening the pivotably movable door.

6. The cleaning bin of claim 5, wherein the door release latch mechanism comprises a button positioned in a top surface of the cleaning bin.

7. The cleaning bin of claim 1, further comprising:

transition portion proximate to the filter socket configured such that the airflow travels from the airflow chamber into the transition portion and then into the filter socket.

8. The cleaning bin of claim 1, wherein the debris chamber has a volume of between 350 and 500 mL.

9. The cleaning bin of claim 1, comprising a bin attachment hook configured to interface with a socket of the autonomous cleaning robot when inserting and removing the cleaning bin.

10. The cleaning bin of claim 9, wherein the bin attachment hook has a height of between approximately 35 and 55 mm.

11. The cleaning bin of claim 9, wherein the bin attachment hook has tapered ends configured to aid in aligning the bin with the autonomous cleaning robot during insertion and removal of the cleaning bin.

12. The cleaning bin of claim 1, wherein the cleaning bin has a curved outer surface complementary to a curved outer surface of a body of the autonomous cleaning robot.

13. A cleaning bin mountable to an autonomous cleaning robot operable to receive debris from a floor surface, the cleaning bin comprising:

an inlet positioned between lateral sides of the cleaning bin;

an outlet located on one of the lateral sides, the outlet configured to connect to a vacuum assembly, the vacuum assembly operable to direct an airflow from the inlet of the cleaning bin to the outlet of the cleaning bin;

a debris chamber to receive debris from the airflow;

an airflow chamber separated from the debris chamber by a prefilter, the prefilter forming at least a portion of a top surface of the debris chamber and at least a portion of a bottom surface of the airflow chamber; and a filter socket located at the outlet of the airflow chamber and the cleaning bin, the filter socket configured to receive a filter and provide the airflow to through the filter to the outlet of the cleaning bin, wherein the filter is positioned vertically and perpendicular to the prefilter, the debris chamber, and the airflow chamber when the filter is positioned in the filter socket.

14. The cleaning bin of claim 13, wherein the inlet includes a pivotably moveable door.

15. The cleaning bin of claim 14, comprising a door release latch mechanism for opening the pivotably movable door.

16. The cleaning bin of claim 15, wherein the door release latch mechanism comprises a button positioned in a top surface of the cleaning bin.

17. A cleaning bin mountable to an autonomous cleaning robot operable to receive debris from a floor surface, the cleaning bin comprising:

an inlet positioned between lateral sides of the cleaning bin;

an outlet located on one of the lateral sides, the outlet configured to connect to a vacuum assembly, the vacuum assembly operable to direct an airflow from the inlet of the cleaning bin to the outlet of the cleaning bin;

a debris chamber to receive debris from the airflow;

an airflow chamber separated from the debris chamber by a prefilter, the prefilter forming at least a portion of a top surface of the debris chamber and at least a portion of a bottom surface of the airflow chamber;

a filter socket located at the outlet of the cleaning bin and configured to receive a filter and provide the airflow to flow through the filter to the outlet of the cleaning bin, wherein the filter is positioned substantially perpendicular to the prefilter when the filter is positioned in the filter socket, and a notch releasably engageable with a bin latch of the autonomous cleaning robot to separate the cleaning bin from a body of the robot and the vacuum assembly.

18. The cleaning bin of claim 17, wherein the cleaning bin is absent exposed metallic components.

19. The cleaning bin of claim 17, wherein the inlet includes a pivotably moveable door.

20. The cleaning bin of claim 19, comprising a door release latch mechanism for opening the pivotably movable door.

* * * * *